US007232111B2

(12) United States Patent
McDaniel et al.

(10) Patent No.: US 7,232,111 B2
(45) Date of Patent: Jun. 19, 2007

(54) CONTROL ARRANGEMENT FOR AN AUTOMATIC RESIDENTIAL FAUCET

(75) Inventors: Jason A. McDaniel, Batavia, OH (US); Patrick Jonte, Zionsville, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 45 days.

(21) Appl. No.: 10/755,582

(22) Filed: Jan. 12, 2004

(65) Prior Publication Data

US 2005/0151101 A1 Jul. 14, 2005

(51) Int. Cl.
*F16K 31/02* (2006.01)

(52) U.S. Cl. ..... 251/129.04; 4/623

(58) Field of Classification Search ..... 251/129.03, 251/129.04; 356/5.03; 367/95, 96; 342/124, 342/136; 4/623
See application file for complete search history.

(56) References Cited

U.S. PATENT DOCUMENTS 4,156,875 A * 5/1979 Keane et al. ..... 342/62
4,213,197 A * 7/1980 Magori ..... 367/94
4,402,095 A * 9/1983 Pepper ..... 4/623
4,520,516 A * 6/1985 Parsons ..... 4/623
4,688,277 A 8/1987 Kakinoki
4,942,631 A * 7/1990 Rosa ..... 4/623
4,962,790 A * 10/1990 Chou et al. ..... 137/599.08
4,981,158 A * 1/1991 Brondolino et al. ... 137/624.11
5,025,516 A * 6/1991 Wilson ..... 4/623
5,550,369 A 8/1996 Skell et al. ..... 250/222.1
5,566,702 A * 10/1996 Philipp ..... 137/1
5,744,793 A 4/1998 Skell et al. ..... 250/222.1
5,758,688 A * 6/1998 Hamanaka et al. .... 137/624.11
5,855,356 A * 1/1999 Fait ..... 251/129.04
6,003,170 A 12/1999 Humpert (Continued)

FOREIGN PATENT DOCUMENTS

EP 1 528 411 A1 5/2005

(Continued)

OTHER PUBLICATIONS

Technical Concepts, AutoFacet with "Surround Sensor" Technology 500484 500485, 2003, Technical Concepts, CATA6353, p. 3.*

(Continued)

*Primary Examiner*—Eric Keasel
*Assistant Examiner*—Andrew J. Rost
(74) *Attorney, Agent, or Firm*—Woodard, Emhardt, Moriarty, McNett & Henry LLP

(57) ABSTRACT

A hands-free faucet comprises a spout, a valve, a position sensitive device, and a logical control. The position sensitive device is positioned on the user's side of the spout, and has a trigger zone and an extended zone, each defined in part by a distance range from the position sensitive device. The logical control comprises a manual mode, wherein the position sensitive device is deactivated and the valve remains open, and a hands-free mode, wherein the valve is opened when the position sensitive device detects an object within the trigger zone, and wherein the valve is closed only when the position sensitive device does not detect an object within the trigger zone and does not detect an object that is moving within the extended zone.

12 Claims, 4 Drawing Sheets

U.S. PATENT DOCUMENTS

| | | | | |
|---|---|---|---|---|
| 6,111,537 | A * | 8/2000 | Andersson | 342/137 |
| 6,250,601 | B1 | 6/2001 | Kolar et al. | 251/129.04 |
| 6,273,394 | B1 | 8/2001 | Vincent | |
| 6,281,833 | B1 * | 8/2001 | Pringle et al. | 342/95 |
| 6,363,549 | B2 | 4/2002 | Humpert | |
| 6,962,168 | B2 | 11/2005 | McDaniel et al. | 137/624.12 |
| 2001/0011390 | A1 | 8/2001 | Humpert | |
| 2005/0285024 | A1 | 12/2005 | Eubelen | 250/221 |

FOREIGN PATENT DOCUMENTS

| | | |
|---|---|---|
| JP | 2000-336715 | 12/2000 |
| JP | 2003-147823 | 5/2003 |
| WO | WO 97/25634 | 7/1997 |

OTHER PUBLICATIONS

TOTO Products, "Commercial Faucets", 2 pages.
Zurn Plumbing Products Group, 07Aquasense Sensor Operated Faucets, 2 pages.
SLOAN, Optima i.q. Faucet, 1 page.
Symmons, "Ultra-Sense S-6080", 1 page.
Technical Concepts, AutoFaucet® with "Surround Sensor" Technology, 2 pages.
Symmone Industries, Inc. of 31 Brooks Drive, Braintree, MA 02184-3804, advertising brochure "Ultra-Sense", 1999-2004, 4 pgs.

* cited by examiner

CONTROL ARRANGEMENT FOR AN AUTOMATIC RESIDENTIAL FAUCET

BACKGROUND OF THE INVENTION

1. Field of the Invention

The present invention generally relates to the field of automatic faucets. More particularly, the present invention relates to a control arrangement for automatic faucets that interprets detailed information about the location and motion of objects to determine the intentions of a user, thereby providing an automatic faucet that is easier and more efficient to use.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent vandalism.

One early version of an automatic faucet was simply a spring-controlled faucet, which returned to the "off" position either immediately, or shortly after, the handle was released. The former were unsatisfactory because a user could only wash one hand at a time, while the later proved to be mechanically unreliable.

A better solution was hands-free faucets. These faucets employed a proximity detector and an electric power source to activate water flow without the need for a handle. In addition to helping to conserve water and prevent vandalism, hands-free faucets also had additional advantages, some of which began to make them popular in homes, as well as public bathrooms. For example, there is no need to touch the faucet to activate it; with a conventional faucet, a user with dirty hands may need to wash the faucet after washing their hands. Non-contact operation is also more sanitary, especially in public facilities. Hands-free faucets also provide superior accessibility for the disabled, or for the elderly, or those who need assisted care.

Typically, these faucets use active infrared ("IR") detectors in the form of photodiode pairs to detect the user's hands (or other objects positioned in the sink for washing). Pulses of IR light are emitted by one diode. When an object enters the detection zone, the other diode detects reflections of the emitted light off the object. Different designs use different locations on the spout for the photodiodes, including placing them at the head of the spout, farther down the spout near its base, or even at positions entirely separate from the spout.

Examples of hands-free faucets are given in U.S. Pat. No. 5,566,702 to Philippe, and U.S. Pat. No. 6,273,394 to Vincent, and U.S. Pat. No. 6,363,549 to Humpert, which are hereby incorporated in their entireties.

One shortcoming of typical automatic hands-free faucets is the potential for their activation by false detections. A stray object in the sink, such as a toppled bottle, or dishes left to dry, may trip the IR detectors and activate the water. Potentially, the faucet can become "stuck" on, leaving the water running indefinitely until a user returns and notices the running water, and clears the stray object. A number of control systems have been developed to attempt to combat this shortcoming, such as the one disclosed in U.S. Pat. No. 5,566,702 to Philippe.

This shortcoming is merely one example of the ways in which existing hands-free faucets imperfectly respond to the intentions of the user. Ideally, the natural and reflexive actions of the user in positioning objects under the spout of the faucet will activate water flow when it is desired, and at no other time.

Thus, what is needed is a control arrangement that can receive and interpret more detailed information about what the user is doing, and use that information to more accurately determine the intentions of the user. In particular, a control arrangement is needed that reduces or eliminates the potential false detections caused by stray objects, and which is therefore less prone to being stuck in an on state. A control arrangement is also needed that can better discriminate between objects left in the sink basin, such as dishes left to dry, and the hands of a user who is actively using the sink. A control arrangement is needed that can achieve these goals without requiring excessive power consumption, resulting in the need for frequent changing of batteries. The present invention is directed towards meeting these needs, among others.

BRIEF SUMMARY OF THE INVENTION

In a first embodiment, the present invention provides a hands-free faucet for permitting a user to activate and deactivate water flow without physical contact with the faucet. The hands-free faucet comprises: a spout; a valve in series with the spout, that has an open position and a closed position; a position sensitive device having a trigger zone defined in part by a distance range, and which generates a trigger signal when the position sensitive device detects and object within the trigger zone; and a logical control that causes the valve to move to the open position in response to the trigger signal.

In a second embodiment, the present invention provides a hands-free faucet for permitting a user to activate and deactivate water flow without physical contact with the faucet. The hands-free faucet comprises: a spout having a user's side that is closer to the position of the user when using the faucet; a valve; and a position sensitive device positioned on the user's side of the spout, the position sensitive device having a trigger zone and an extended zone, each defined in part by a distance range from the position sensitive device. A logical control comprises: a manual mode, wherein the position sensitive device is deactivated and the valve remains open; and a hands-free mode, wherein the valve is opened when the position sensitive device detects an object within the trigger zone, and wherein the valve is closed only when the position sensitive device does not detect an object within the trigger zone and does not detect an object that is moving within the extended zone.

In a third embodiment, the present invention provides a hands-free faucet comprising a proximity sensor having a detection zone. The detection zone comprises: a trigger zone, in which presence of an object activates water flow; and an extended zone, wherein presence of an object does not activate water flow, but causes existing water flow to continue.

In a fourth embodiment, the present invention provides a hands-free faucet comprising a means for detecting the motion of objects within a detection zone, the hands-free faucet being adapted to run water in response to motion that is detected by the means for detecting motion.

BRIEF DESCRIPTION OF THE SEVERAL VIEWS OF THE DRAWINGS

Although the characteristic features of this invention will be particularly pointed out in the claims, the invention itself, and the manner in which it may be made and used, may be better understood by referring to the following descriptions taken in connection with the accompanying figures forming a part hereof.

DETAILED DESCRIPTION OF THE INVENTION

For the purposes of promoting an understanding of the principles of the invention, reference will now be made to the preferred embodiment and specific language will be used to describe the same. It will nevertheless be understood that no limitation of the scope of the invention is thereby intended. Such alternations and further modifications in the invention, and such further applications of the principles of the invention as described herein as would normally occur to one skilled in the art to which the invention pertains, are contemplated, and desired to be protected.

A hands-free faucet according to the present invention has a superior ability to turn the water on and off in accord with the user's wishes, because it has a superior ability to receive and interpret information about what a user is doing. Thus, a hands-free automatic faucet according to the present invention is easier and more efficient to use.

Figure 1:
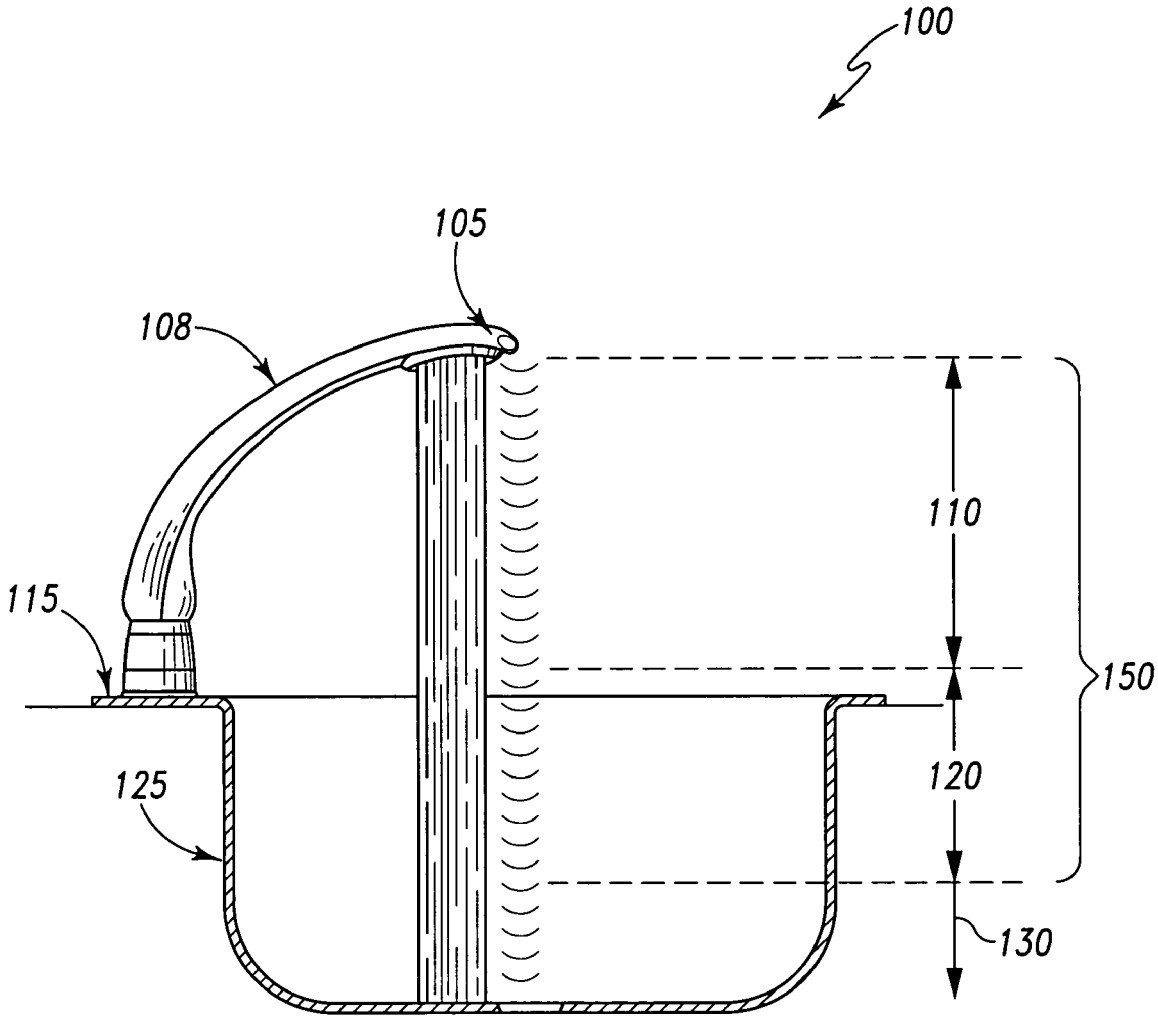
FIG. 1 is a diagram of a preferred embodiment faucet according to the present invention.

FIG. 1 illustrates the general configuration of the preferred embodiment faucet according to the present invention, indicated generally at 100. Unlike the typical faucet, in the preferred embodiment faucet 100 the proximity sensor 105 is positioned near the end of the outlet 108, and is directed essentially downwards, as shown in FIG. 1. The proximity sensor 105 is preferably located in front of the water stream 101, so that when an object is moved under the spout 108 it will pass under the detector 105 before arriving under the water stream 101. This is more convenient for the user, since it means the faucet 100 responds more quickly. (Alternatively, the detector 105 may be positioned to one side of the water stream 101, or even at the back of the stream 101.) Furthermore, with the proximity sensor 105 positioned as shown, the water stream 101 does not pass within its detection zone 150, which reduces or eliminates the tendency of the faucet 100 to be triggered by the water itself, thereby becoming "locked on." This orientation also provides a large detection zone 150 that corresponds well with the area where a user naturally positions objects under the faucet 100 for washing or filling.

Figure 2:
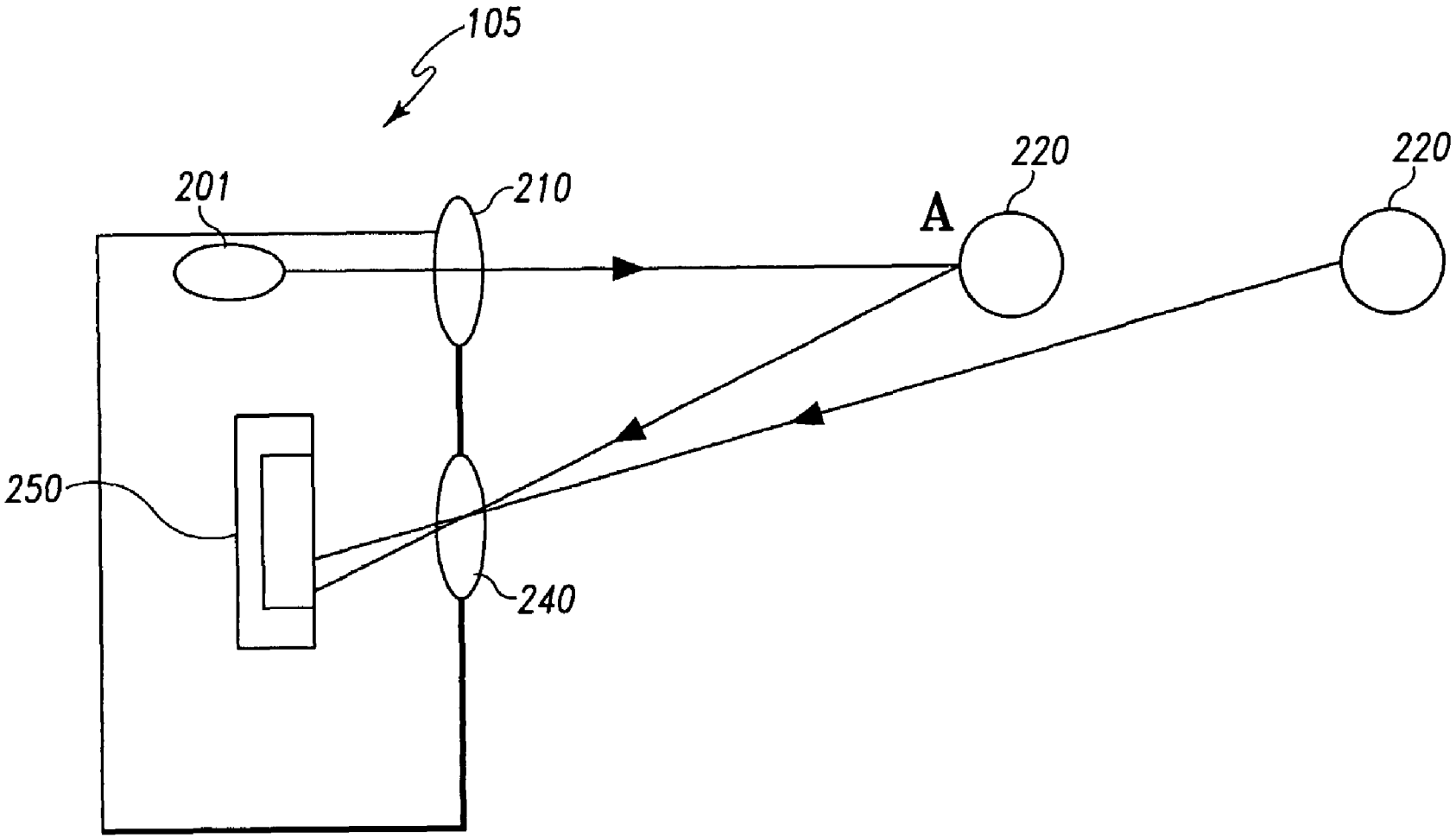
FIG. 2 is a diagram showing the principle of operation of a position sensitive device suitable for use in the faucet of FIG. 1.

A control arrangement according to the present invention uses a position sensitive device ("PSD"), such as a GP2D12/15 or GP2Y0A21YK/D21YK, manufactured and sold by Sharp, for the proximity sensor 105. Unlike the IR sensors used in prior art automatic faucets, position sensitive devices respond to the position of a returned signal. This is illustrated in FIG. 2. An LED 201 emits a signal, which is collimated by a first lens 210. When the signal is reflected by an object 220, a portion of the signal returns to a second lens 240, which is then focused on a linear sensor 250. As shown in FIG. 2, the returning signal is incident upon different positions on the sensor 250 as a function of the distance of the object 220. Thus, the PSD 105 has a direct measure of the distance to the detected object that is not a function of the intensity of the returned signal. This is valuable, because it permits the PSD to be insensitive to environmental noise, such as external sources of radiant energy in the signal's wavelength. (It will be appreciated that the average kitchen may include many such extraneous sources in the IR range, which is the preferred signal frequency range.) For the same reason, the PSD 105 is less prone to being fooled by different object properties, such as albedo (reflectiveness).

Thus, it will be appreciated, the PSD's 105 detection zone is based on a distance range from the PSD 105. Furthermore, the PDS's 105 detection zone can be subdivided into more specific regions that are also based on distance ranges, as described in greater detail hereinbelow, in order to provide superior behavior.

In the preferred embodiment the PSD 105 is adapted to detect the presence of objects within a trigger zone 110 and an extended zone 120. Preferably, the boundaries of the trigger zone 110 and extended zone 120 are generally those illustrated in FIG. 1, with the trigger zone 110 being entirely above the sink deck 115, and the extended zone 120 including the area beyond the trigger zone, but excluding the bottom portion 130 of the sink basin 125. Note that the trigger zone 110 and extended zone 120 are also defined by the angular width of the detection zone of the proximity detector. In certain alternative embodiments the extended zone 120 subtends a greater angular area than the trigger zone 110, but in the preferred embodiment the angular width of the trigger zone 110 and extended zone 120 are identical, and have a cross-sectional area of about a quarter.

One theoretical shortcoming of the preferred PSD's 105 is the potential for false readings caused by highly reflective objects. The PSD 105 presumes that the surface of the object is normal to the outgoing signal. This assumption is essentially valid with respect to diffused reflection. But with highly reflective surfaces the angle of incidence equals the angle of reflection. This is not a serious problem, though, because the probability of the returned signal from a highly reflective surface happening to hit the linear sensor 250 is relatively small. On the other hand, diffused reflected signals, by their nature, radiate outwards in all directions from the point of incidence, so that they are almost always incident upon the detector. Consequently, although certain articles commonly found in kitchen sinks—most notably, knives—have shiny, flat surfaces, most often the PSD 105 operates properly, even in the presence of such items.

It will be appreciated that the above-described PSD 105 permits the preferred embodiment faucet 100 to use regions having different boundaries for the purposes of turning water flow off and on. In particular, in the preferred embodiment the faucet activates water flow in response to the presence of objects within the trigger zone 110, but deactivates water flow in response to the absence of objects anywhere in the detection zone 150. (Preferably, the faucet deactivates water flow based on the absence of any objects in the trigger zone 110 and moving objects within the extended zone 120, but in certain alternative embodiments the faucet 100 turns water flow off in response to the absence of any objects, whether moving or not, anywhere within the detection zone 150.) Thus, the extended zone 120 is a zone in which the presence of objects (preferably, but not necessarily, only moving objects) causes the faucet to continue running water, but not to initiate water flow.

Preferably, the PSD 105 controls the faucet 100 via electronic circuitry that implements a logical control for the faucet. The logical control interprets the signal from the PSD 105 to determine when the faucet 100 should be opened and closed, and then does so by issuing appropriate instructions to an electrically controlled valve. (For example the logical control can toggle a solenoid valve, such as a magnetically latching solenoid valve.) In the preferred embodiment, when the PSD 105 is activated and an object enters the trigger zone 110 the valve is opened, but an object within the extended zone 120 does not cause the valve to be opened. However, once opened, the valve is not closed as long as a moving object is detected in the extended zone 120. Thus, the preferred embodiment faucet 100 maintains water flow in response to motion within the extended zone 120, as opposed to merely the presence of an object. In certain alternative embodiments, water flow can actually be activated in response to motion within the extended zone 120.

In the preferred embodiment, an object is seen to be moving either because its range from the PSD 105 is changing over time, or because it is appearing and disappearing within the detection zone 120, regardless of the range from the PSD 105.

Preferably, the logical control includes at least two modes: a manual mode, wherein the PSD 105 is deactivated and valve remains open, and a hands-free mode, wherein the valve is toggled in response to signals from the proximity sensor 105. In the manual mode the faucet 100 is controlled by the position of a handle like a conventional faucet, while in the hands-free mode, the flow is toggled on and off in response to the proximity sensor 105. This is discussed in greater detail in the concurrently filed application entitled "Multi-Mode Hands-Free Automatic Faucet," which is hereby incorporated in its entirety.

Preferably, the logical control also includes one or more timers, which are also used to determine when to open and close the valve. As described hereinbelow, one timer, termed the "safety timer" herein, is used to shut off the water after it has been running for a predetermined period without any change in stimuli. This protects against flooding in the event that some object is left in, or is accidentally introduced into, the trigger zone 110. Another timer is used to determine when the shut off water after an object has been removed from the detection zone 150.

Figure 3A:
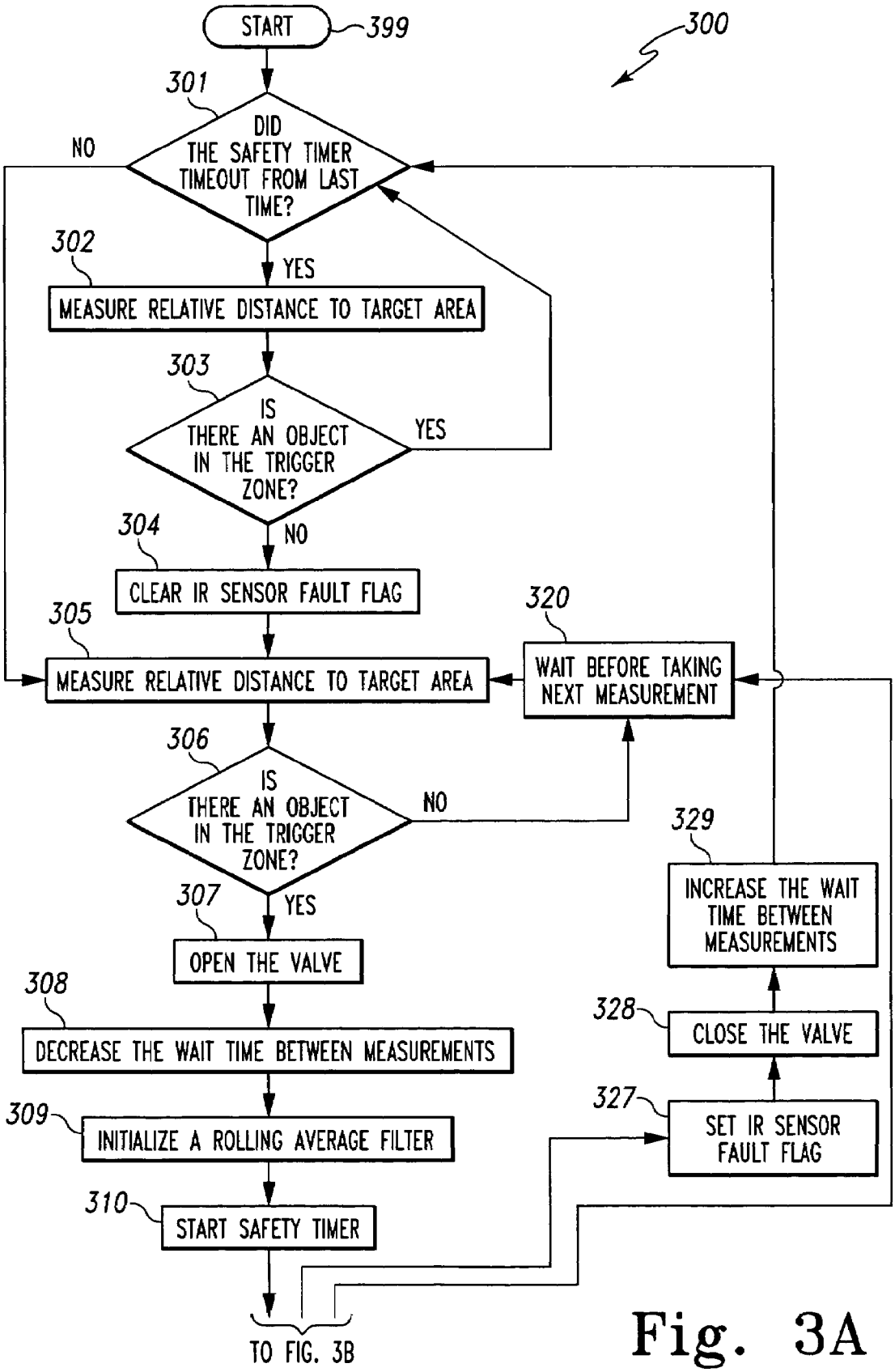
FIGS. 3A and 3B together are flowchart of a logical control suitable for use in the faucet of FIG. 1.
Figure 3B:
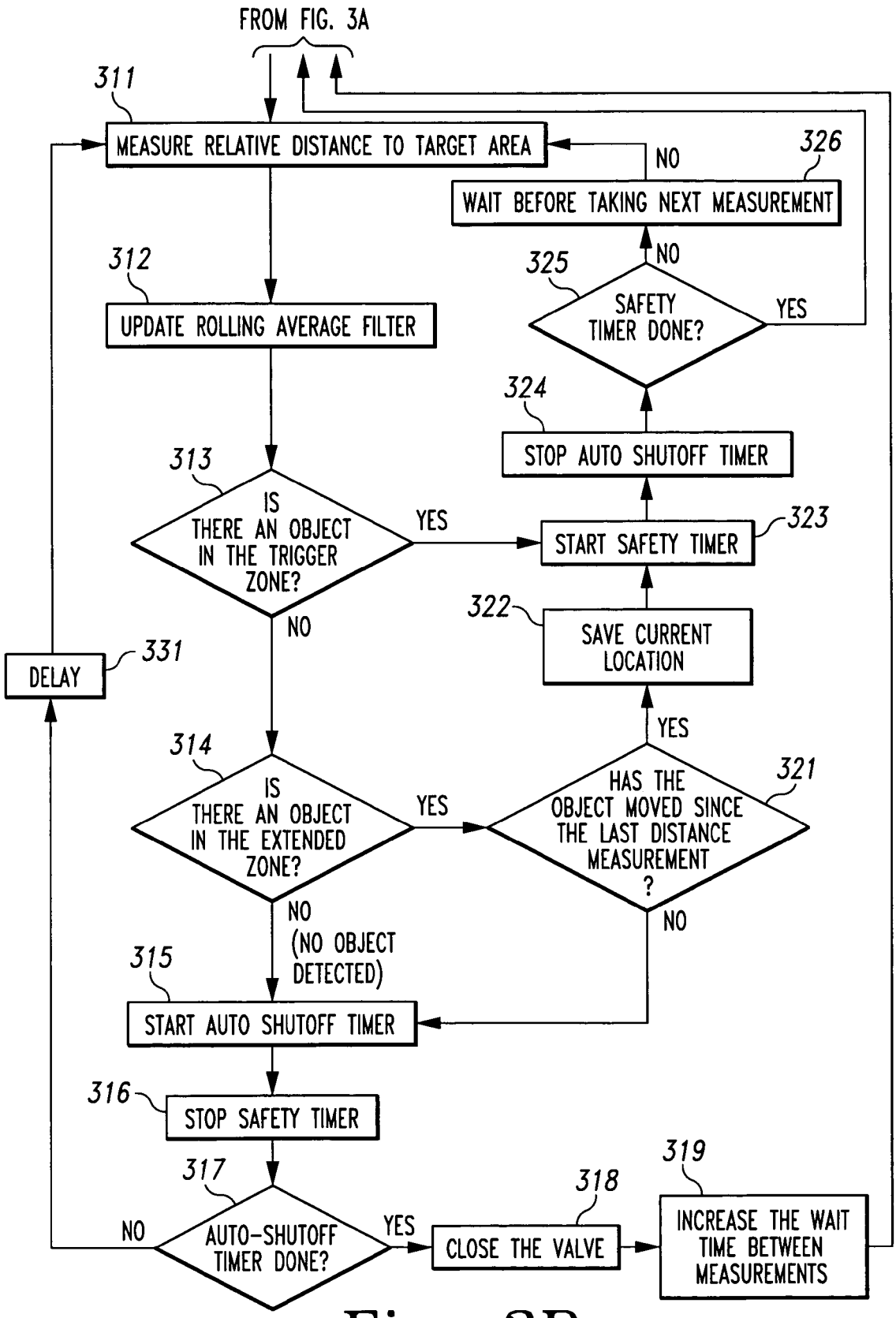

FIG. 3 is a flow chart illustrating further details of a preferred embodiment logical control for a hands-free faucet according to the present invention, indicated generally at 300. The logical control 300 initializes at the start 399. At step 301 it is determined whether the safety timer has expired. (Naturally, immediately after initialization this is impossible, since the safety timer has not yet been started.) If at step 301 the safety timer has not expired, at step 305 the distance to the target area is measured. At step 306 it is then determined whether an object is within the trigger zone 110. If not, at step 320 the logical control 300 pauses, before returning to step 305.

The period of the pause at step 320 is relatively long, so that while the faucet 100 is not in immediate use the rate at which detections are performed is relatively low, thereby reducing power drain. However, the period should not be so long as to cause an irritating delay between the time when a user places their hands or other objects under the faucet 100 and when the water begins to run. It has been determined that a good period of time for the delay at step 320 is between about 200 and 350 ms, and preferably about 300-330 ms. It will be appreciated that the period of delay is easily modifiable; consequently, in various embodiments the period of delay is modified in response to a variety of factors, including feedback from the logical control and user preference, as described in greater detail hereinbelow.

If at step 306 it is determined that an object is within the trigger zone 110, then at step 307 the valve is opened to permit the water to begin running. At step 308 the period of delay between measurements is adjusted downward, so that detections are performed at a higher rate. Preferably, these detections are performed at intervals of no more than about 100 ms.

At step 309 a rolling average filter is initialized. It will be appreciated that a rolling average filter is a filter in which each new value is given a constant weight against the accumulated average. For example, in one embodiment a rolling filter simply averages the accumulated average with the new value. Thus, the contribution of each value in a continuous series decays as new values are generated. This is useful in cases, such as the instant invention, where data is expected to become obsolete over time.

The purpose of the rolling filter to identify motion of objects that are detected by the proximity detector, while ignoring small changes in position that may be caused, especially, by waves in water.

Once the rolling average filter is initialized at step 309, at step 310 the safety timer is started. At step 311 the distance to the target area is measured. At step 312 the rolling average filter is updated using the distance measured to the target area.

After updating the rolling average filter at step 312, at step 313 it is determined whether there is an object in the trigger zone 110. If so, the logical control 300 proceeds to step 323, as described hereinbelow. If at step 313 it is determined that there is not an object in the trigger zone 110, at step 314 it is determined whether there is an object in the extended zone 120. If it is determined there is no object in the extended zone 120 at step 314, at step 315 the auto-shutoff timer is started. At step 316 the safety timer is stopped. Then at step 317 it is determined whether the auto-shutoff timer has expired. If at step 317 the auto-shutoff timer has not expired, the logical control 300 delays at step 331, before returning to step 311, where another detection is performed.

If at step 317 it is determined that the auto-shutoff timer has expired, at step 318 the valve is closed to shut off the water flow, at step 319 the wait time between detections is increased, and the logical control 300 returns to step 320.

If at step 314 it is determined that an object is within the extended zone 120, at step 321 it is determined whether the object has moved since the last distance measurement. Preferably, the motion determination is made by comparing the distance at which the object is seen to the value in the rolling average filter. If the distance is greater than a predetermined threshold, it is considered to be in motion. As previously discussed, the threshold distance should be greater than what might be observed in, for example, waves in the surface of water in the sink basin or a container within the sink, such a pot, bowl, etc. In addition, motion is preferably inferred when an object is detected at the same range from the PSD but in non-successive detections. That is, when the auto-shutoff timer is started at 315, but an object is later detected at some iteration of step 311 before the auto-shutoff timer expires, the object is preferably assumed to be in motion, without respect to the range at which the object is detected. Alternatively, motion can be inferred only when the range to the detected object changes during such non-successive detections, or even inferred only when the range to the detected object does not change, or changes by less than a predetermined threshold amount.

If it is determined at step 321 that the object in the extended zone 120 has not moved since the last detection, the logical control 300 proceeds to step 315 to start the auto-shutoff timer. If it is determined at step 321 that the object in the extended zone 120 has moved since the last detection, at step 322 the new location of the object is stored for comparison with future detections. At step 323 the safety timer is started, and at step 324 the auto-shutoff timer is stopped. At step 325 it is determined whether the safety timer has expired. If not, at step 326 the logical control 300 delays, before proceeding to make a new detection at step 311. Note that the delay at step 326 is shorter than the delay at step 320, because the period was reduced at step 308. As previously discussed, it has been determined by the inventors that the period of the delays at step 320 should generally be between 200 ms and 350 ms, and preferably about 300 ms, while at step 326 the delays are preferably about 100 ms.

If at step 325 it is determined that the safety timer has expired, at step 327 an IR sensor fault flag is set, to indicate that the water is "stuck" on. Referring back to step 301, if this flag is set, the logical control 300 determines that the safety timer did time out, and proceeds to step 302 to measure the distance to the object in the detection zone 150. At step 303, as long as any object remains anywhere in the trigger zone 110, preferably the logical control 300 returns to step 301. In this way, the faucet 100 will remain closed until the detection zone 150 is cleared by a user. Once the trigger zone 110 has been cleared (as determined at step 303 by the absence of an object), at step 304 the fault flag is cleared, and the logical control 300 proceeds to step 305. Although in the preferred embodiment the fault flag is cleared when the trigger zone 110 is cleared, in certain alternative embodiments, the fault flag is cleared only when no objects are detected anywhere in the detection zone 150. In still other embodiments, the fault flag is cleared only when no non-moving objects are detected within the detection zone 150, or trigger zone 110.

Returning now to step 327, once the fault flag is set, at step 328 the valve is closed to shut off water flow. At step 329 the wait time between detections is increased back to the "not in use" period, and the logical control returns to step 301.

As described above, the logical control 300 is adapted to adjust the frequency of sampling by the PSD 105. One purpose for adjusting the frequency of sampling is to save power when the faucet is not in active use. Thus, the frequency of sampling is advantageously reduced after a some period in which no objects are detected, or in which the electrically operable valve remains closed, or other such indication of disuse. Conversely, the sampling rate can be increased under certain low information conditions in order to provide better information upon which to make decisions about opening and closing the electrically operable valve. This may be especially useful for observing motion within the extended zone 120, since objects that are moving relatively rapidly back and forth might be observed as being stationary, if, for example, their frequency happens to be a harmonic of the sampling frequency. For another example, if the strength of the returning signal is weak (perhaps due to the distance or reflective properties of the object being detected) the PSD 105 might fail to get a valid measurement for some samples. Also, in some situations, the PSD 105 might receive a returned signal that is "smeared out" across the sensor 250. In these situations, or other such low information conditions, additional samples could be used to better resolve the actual position of the object by statistical means.

It will be appreciated that a control arrangement according to the present invention can advantageously incorporate multiple modes of operation. For example, the concurrently filed application entitled "Multi-Mode Hands-Free Automatic Faucet" discloses a faucet having a hands-free mode and a manual mode, wherein the faucet is controlled like a conventional manual faucet (via a second, manually operated valve). A control arrangement according to the present invention is well suited for use with the hands-free mode in such a multi-mode faucet.

Likewise, a capacitive touch control, disclosed in the concurrently filed application entitled "Capacitive Touch On/Off Control for an Automatic Faucet" (which is hereby incorporated in its entirety), can advantageously be incorporated into a faucet according to the present invention. For example, in certain such embodiments the logical control 300 is suspended when the touch control is activated by the user. Preferably, when the touch control is again activated by the user, the logical control re-initializes at step 399, though alternatively it could resume at any suitable point in the logical process, including at the point at which it was interrupted by activation of the touch control.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the forgoing can be made without departing from the scope of the following claims.

What is claimed is:

1. A hands-free faucet for a sink constructed and arranged for permitting a flow stream of water to be initiated and to be stopped without physical contact with said faucet, said sink including a bottom portion, said hands-free faucet comprising:

a spout having an outlet end;

a valve in series with said spout and being movable between an open position wherein the flow stream of water is in initiated and a closed position wherein the flow stream of water is stopped;

a position sensitive detection device having a trigger zone defined in part by a distance range and having an extended zone, said position sensitive detection device being assembled into said hands-free faucet adjacent said outlet end and being constructed and arranged for providing an optical signal directed toward said bottom portion, said position sensitive detection device being constructed and arranged for generating a trigger signal when said position sensitive detection device detects an object within said trigger zone; and logic control means for causing said valve to move to said open position in response to said trigger signal, said logic control means having a manual mode and a hands-free mode, said position sensitive detection device being deactivated when said hands-free faucet is in said manual mode and said valve remaining open, said valve being opened in said hands-free mode when said position sensitive detection device detects an object within said trigger zone, wherein said valve is closed only when said position sensitive detection device does not detect an object within said trigger zone and does not detect an object that is moving within said extended zone.

2. The hands-free faucet of claim 1 wherein said position sensitive detection device is constructed and arranged such that the presence of an object within said extended zone influences said logic control means, causing an initiated flow stream of water to continue.

3. The hands-free faucet of claim 1 wherein said position sensitive detection device is constructed and arranged such that the movement of an object within said extended zone influences said logic control means, causing an initiated flow stream of water to continue.

4. The hands-free faucet of claim 1 wherein said logic control means is constructed and arranged such that when the hands-free faucet is in said hands-free mode, the valve is toggled in response to the trigger signal.

5. The hands-free faucet of claim 1 wherein said position sensitive detection device makes measurements at a plurality of frequencies, including at least a faster frequency and a slower frequency.

6. The hands-free faucet of claim 5 wherein said faster frequency is used for a period of time following a detection of an object.

7. The hands-free faucet of claim 6 which further includes a safety timer constructed and arranged to shut off the flow stream of water after the flow stream has been running for a period of time.

8. The hands-free faucet of claim 5 wherein said faster frequency is used to provide superior information in at least one low information condition.

9. The hands-free faucet of claim 5 wherein said slower frequency has an interval between measurements of between approximately 200 ms and about 350 ms, and said faster frequency has an interval between measurements of approximately 100 ms.

10. The hands-free faucet of claim 1 wherein said sink including a sink deck and said trigger zone being entirely above said sink deck.

11. A hands-free faucet for permitting the user to activate and deactivate a flow stream without physical contact with said faucet, said hands-free faucet comprising:

a spout having a user's side that is closer to the position of said user when using the faucet;

a valve that controllably limits flow through said spout;

a position sensitive detection device positioned on the user's side of said spout, said position sensitive detection device having a trigger zone and an extended zone, each zone being defined in part by a distance range from said position sensitive detection device; and logic control means having:

a manual mode, wherein the position sensitive detection device is deactivated and said valve remains open; and a hands-free mode, wherein said valve is opened when said position sensitive detection device detects an object within said trigger zone, and wherein the valve is closed only when the position sensitive detection device does not detect an object within said trigger zone, and does not detect an object that is moving within said extended zone.

12. A hands-free faucet comprising:

a position sensitive detection device having a detection zone including a trigger zone and an extended zone, said hands-free faucet being constructed and arranged wherein the presence of an object in said trigger zone activates a flow stream, and wherein the presence of an object within said extended zone causes an existing flow stream to continue; and logic control means having a manual mode and a hands-free mode, said position sensitive detection device being deactivated when said hands-free faucet is in said manual mode and said valve remaining open, said valve being opened in said hands-free mode when said position sensitive detection device detects an object within said trigger zone, wherein said valve is closed only when said position sensitive detection device does not detect an object within said trigger zone and does not detect an object that is moving within said extended zone.

* * * * *